US012583696B2

(12) United States Patent
Lee

(10) Patent No.: US 12,583,696 B2
(45) Date of Patent: Mar. 24, 2026

(54) DOCUMENT FEED DEVICE WITH ASCENDABLE DOCUMENT GUIDE MEMBER

(71) Applicant: Hewlett-Packard Development Company, L.P., Spring, TX (US)

(72) Inventor: Junghoon Lee, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 276 days.

(21) Appl. No.: 18/030,124

(22) PCT Filed: May 17, 2021

(86) PCT No.: PCT/US2021/032725
§ 371 (c)(1),
(2) Date: Apr. 4, 2023

(87) PCT Pub. No.: WO2022/076037
PCT Pub. Date: Apr. 14, 2022

(65) Prior Publication Data

US 2023/0373739 A1 Nov. 23, 2023

(30) Foreign Application Priority Data

Oct. 8, 2020 (KR) ..... 10-2020-0129788

(51) Int. Cl.
*B65H 3/66* (2006.01)
*B65H 3/06* (2006.01)

(52) U.S. Cl.
CPC ..... *B65H 3/0684* (2013.01); *B65H 3/66* (2013.01); *B65H 2601/254* (2013.01)

(58) Field of Classification Search
CPC ... B65H 3/0684; B65H 3/66; B65H 2601/254
See application file for complete search history.

(56) References Cited

U.S. PATENT DOCUMENTS

| | | | | |
|---|---|---|---|---|
| 5,324,019 | A | 6/1994 | Chang et al. | |
| 5,419,544 | A | 5/1995 | Ono et al. | |
| 5,695,182 | A | 12/1997 | Sekine | |
| 6,641,132 | B2 | 11/2003 | Sekine | |
| 2008/0277863 | A1 * | 11/2008 | Matsutomo | B65H 3/5261 271/262 |

(Continued)

FOREIGN PATENT DOCUMENTS

| | | | |
|---|---|---|---|
| GB | 2127383 | A | 4/1984 |
| JP | 4-15718 | * | 4/1992 |

(Continued)

*Primary Examiner* — Thomas A Morrison
(74) *Attorney, Agent, or Firm* — Foley & Lardner LLP

(57) ABSTRACT

A document feed device includes a tray in which a document is loaded, a pickup roller to be moved upward or downward to a standby position spaced apart from the document or to a pickup position to pick up the document in the tray, a separator to separate each sheet of the picked-up document, an inclined guide to connect an end of an exit of the tray to an entrance of the separator and to guide a bottom surface of the picked-up document, and a document guide member movable to a first position protruding from the inclined guide to guide the picked-up document or to a second position below the inclined guide.

12 Claims, 5 Drawing Sheets

(56) References Cited

U.S. PATENT DOCUMENTS

| | | | | |
|---|---|---|---|---|
| 2014/0197593 | A1* | 7/2014 | Machii | B65H 5/062 271/121 |
| 2015/0210490 | A1* | 7/2015 | Katsura | B65H 3/5223 271/121 |
| 2016/0257511 | A1* | 9/2016 | Machida | B65H 5/062 |
| 2018/0305147 | A1* | 10/2018 | Kuriki | B65H 3/0676 |

FOREIGN PATENT DOCUMENTS

| | | | |
|---|---|---|---|
| JP | 2011-006246 | A | 1/2011 |
| JP | 2011-098822 | A | 5/2011 |
| KR | 10-2000-0006233 | U | 4/2000 |
| KR | 10-2007-0073132 | A | 7/2007 |

* cited by examiner

DOCUMENT FEED DEVICE WITH ASCENDABLE DOCUMENT GUIDE MEMBER

BACKGROUND

A scanner refers to a device that emits light to a document and receives light reflected from the document to read an image recorded on the document. The scanner may be used alone or in combination with a printing device that prints an image on a print medium. In order to scan a large number of sheets of a document quickly, the scanner includes a document feed device for picking up each sheet of the document from a tray in which a plurality of sheets of the document are loaded and feeding each sheet of the document in a document feed path. A fixed tray or a movable tray may be employed in a document feed device. In a document feed device employing the fixed tray, a pickup roller approaches the fixed tray and picks up a document. In a document feed device employing the movable tray, a tray is moved toward a pickup roller so that the pickup roller may be brought into contact with a document loaded in the tray. In general, a document loading capacity of the fixed tray is less than that of the movable tray.

BRIEF DESCRIPTION OF THE DRAWINGS

FIGS. 5 and 6 are views illustrating examples of an operation of a document guide member, in which FIG. 5 illustrates a state in which the document guide member is located at a first position when the number of sheets of a document loaded in a tray is large and FIG. 6 illustrates a state in which the document guide member is located at a second position when the number of sheets of the document loaded in the tray is small.

DETAILED DESCRIPTION

Figure 1:
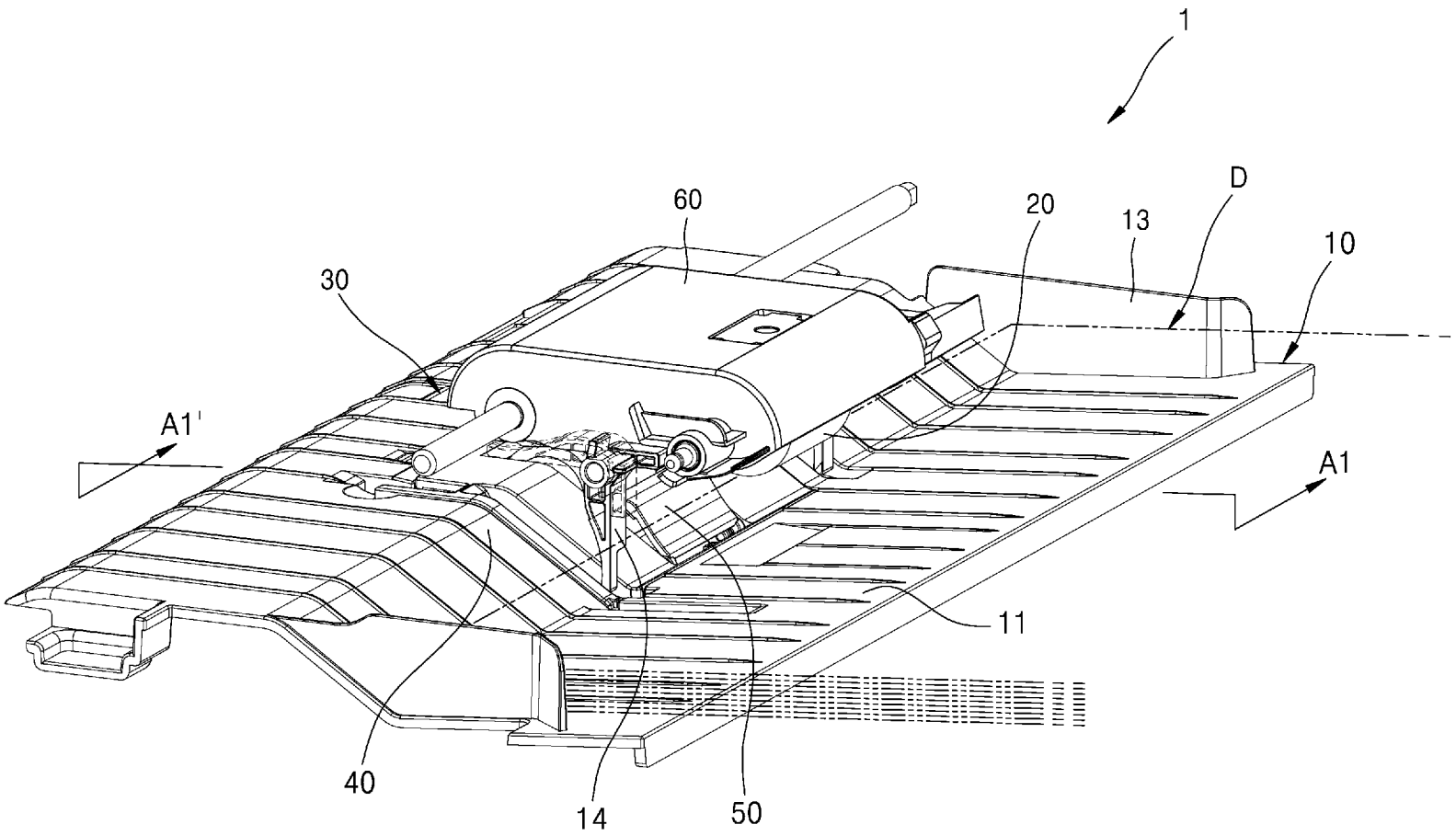
FIG. 1 is a schematic perspective view of an example of a document feed device.

A scanner includes a document feed device to pick up each sheet of a document from a tray in which a plurality of sheets of the document are loaded, and to feed each sheet of the document in a document feed path. The document feed device includes a tray, a pickup roller, and a separator. The pickup roller picks up a document loaded in the tray. The pickup roller picks up the document while being brought into contact with an uppermost sheet of the document among a plurality of sheets of the document loaded in the tray. The separator includes an automatic document feed (ADF) roller, and a separating member to separate a document while being in contact with the ADF roller. When two or more sheets of a document are inserted between the separating member and the ADF roller, a sheet of the document in contact with the ADF roller is separated and transferred in the document feed path. There are a fixed tray and a movable tray. In a document feed device to which the fixed tray is applied, the fixed tray is positioned at a fixed position and a pickup roller approaches a document loaded in the fixed tray to pick up the document. The fixed tray has a simple structure and thus is mainly applied to document feed devices with a loading capacity of 100 sheets or less of paper. In a document feed device to which the movable tray is applied, a document is loaded in the movable tray when the movable tray is positioned at a loading position. When the movable tray approaches a pickup roller, the pickup roller picks up the document. The document feed device employing the movable tray includes a driving mechanism for making the tray be brought closer to or separated from the pickup roller and thus has a complicated structure and is relatively expensive. Therefore, the movable tray is mainly applied to large-capacity document feed devices with a loading capacity of 100 or more sheets of paper.

In general, a document feed speed of the separator is less than that of the pickup roller. This is because slip (or "error") occurs between the ADF roller and a document when each sheet of the document is separated between the ADF roller and the separating member. In this case, the document may be bent between the pickup roller and the separator, and thus, a front end of the document may fold or wrinkle and a document jam may occur in the separator. Between the fixed tray and the separator, a bottom surface of the document is supported by an inclined guide. Among the plurality of sheets of a document loaded in the fixed tray, an uppermost sheet of the document is picked up by the pickup roller. When the number of sheets of a document loaded in the fixed tray is small, the bottom surface of the document is supported by the inclined guide member and the document may be thus transferred smoothly to the separator, even when the document is bent between the pickup roller and the separator. When the number of sheets of a document loaded in the fixed tray is large, a gap between the document when picked up and the inclined guide is large and thus the picked sheet of the document may bend to a large degree until the bottom surface of the document is supported by the inclined guide member. Accordingly, there is a high possibility that the document may fold or wrinkle or a paper jam or the like may occur, and a document loading capacity is limited in a structure using the fixed tray.

There have been attempts to increase document loading capacities of document feed devices employing a low-cost fixed tray. A document feed device of the present example includes a fixed tray, an inclined guide connecting an end of an exit of the fixed tray to an entrance of a separator, and a document guide member movable to a first position protruding from the inclined guide to guide a picked-up document or a second position sunken below the inclined guide. The document guide member may ascend or descend to the first position or the second position according to the amount of a document loaded in the tray. The document guide member may be positioned at the first position when the amount of the document loaded in the tray is large, and moved from the first position to the second position when the amount of the document loaded on the tray decreases. According to this configuration, even when the amount of a document loaded in the tray is large, a bottom surface of the document when picked up may be supported by the document guide member located at the first position, thereby preventing the document from being bent, folded, or wrinkled or preventing a paper jam.

Accordingly, it is possible to implement a document feed device employing a fixed tray having a simple structure and being capable of increasing a document loading capacity. The document guide member may be moved to the first position or the second position in association with an upward or downward movement of the pickup roller. The document guide member and the pickup roller may be connected to each other in a non-contact manner. For example, the document guide member may be elastically biased by an elastic member to be positioned at the first position, and moved from the first position to the second position by a magnetic force as the pickup roller is moved downward. Examples of a document feed device and a scanner employing the document feed device will be described below with reference to the accompanying drawings. In the specification and drawings, elements having substantially the same functional configuration are denoted by the same reference numerals and are not redundantly described here.

Figure 2:
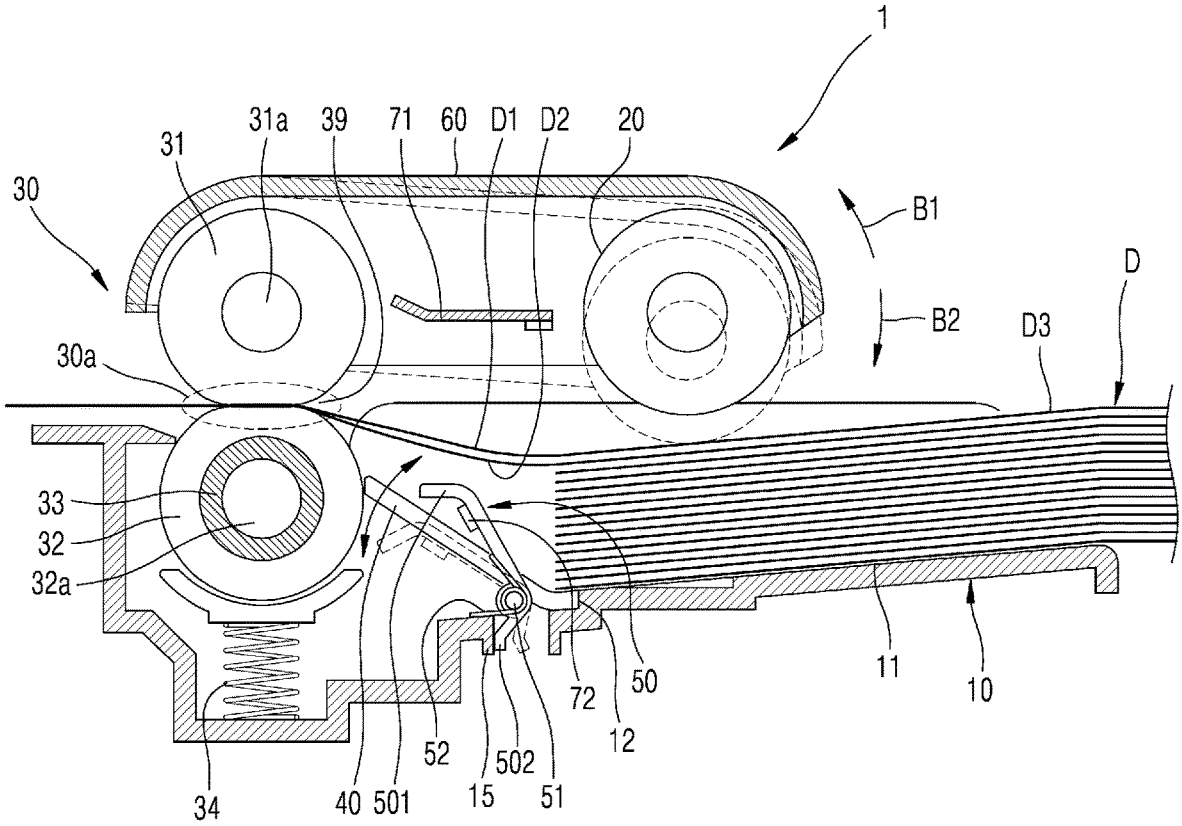
FIG. 2 is a cross-sectional view taken along line A1-A1' of the example of FIG. 1.

FIG. 1 is a schematic perspective view of an example of a document feed device 1. FIG. 2 is a cross-sectional view taken along line A1-A1' of the example of FIG. 1. Referring to FIGS. 1 and 2, the document feed device 1 may include a tray 10 in which a document D is loaded, a pickup roller 20 configured to be moved upward or downward to a standby position spaced apart from the document D or a pickup position for picking up the document D in the tray 10, a separator 30 for separating each sheet of the picked-up document D, an inclined guide 40 for connecting an end of an exit of the tray 10 to an entrance 39 of the separator 30 and guiding a bottom surface of the picked-up document D, and a document guide member 50 movable to a first position (indicated by a solid line of FIG. 2) protruding from the inclined guide 40 to guide the picked-up document D or a second position (indicated by a broken line) sunken below the inclined guide 40.

The tray 10 is a fixed tray of which a loading surface 11 on which the document D is loaded is not movable upward or downward toward the pickup roller 20 and is positioned at a fixed position. A plurality of sheets of a document D loaded on the loading surface 11 are aligned in a width direction W by a pair of first end guides 13. The plurality of sheets of the document D loaded on the loading surface 11 are aligned in a longitudinal direction L by a second end guide 14. When the document D is transferred, the second end guide 14 may be pushed by the document D and be rotated to a position indicated by a broken line in FIG. 1.

The pickup roller 20 may be moved to a standby position (indicated by a solid line of FIG. 2) spaced upward from the document D loaded in the tray 10 or a pickup position (indicated by a broken line of FIG. 2) for picking up the document D loaded in the tray 10. The separator 30 separates each sheet of the picked-up document D. The separator 30 may include, for example, an ADF roller 31 and a separation roller 32 that are engaged with each other to form a separation nip 30*a*. The separation roller 32 is elastically biased by an elastic member 34 in a direction of engagement with the ADF roller 31. Although not shown, the separation roller 32 may be supported by a support frame, and the elastic member 34 may apply an elastic force to the support frame so that the separation roller 32 may be brought into contact with the ADF roller 31.

The separation roller 32 may be connected to a rotation shaft 32*a* by a torque limiter 33. When two or more sheets of the document D are supplied between the ADF roller 31 and the separation roller 32, one sheet of the document D in contact with the ADF roller 31 may be separated and transferred. For example, when two documents D1 and D2 are inserted between the ADF roller 31 and the separation roller 32, a frictional force between the documents D1 and D2 is less than a frictional force between the ADF roller 31 and the document D1 and a frictional force between the separation roller 32 and the document D2. A torque smaller than a limit torque of the torque limiter 33 is applied to the separation roller 32. Accordingly, the separation roller 32 does not rotate, thus preventing the document D2 in contact with the separation roller 32 from being transferred. A slip occurs between the document D1 in contact with the ADF roller 31 and the document D2, and the document D1 is separated and transferred. When the document D1 is inserted between the ADF roller 31 and the separation roller 32, a friction force between the ADF roller 31 and the document D1 is greater than a frictional force between the separation roller 32 and the document D1. A torque equal to or greater than the limit torque of the torque limiter 33 is applied to the separation roller 32. The separation roller 32 slips with respect to the rotation shaft 32*a*. Accordingly, the ADF roller 31 and the separation roller 32 are rotated together in a direction in which the document D1 is taken out of the tray 10. A structure of the separator 30 is not limited to the examples of FIGS. 1 and 2, and the separator 30 may have well-known various structures. For example, a friction pad (not shown) may be applied to form the separation nip 30*a* when brought into contact with the ADF roller 31, instead of the separation roller 32.

The pickup roller 20 may be supported rotatably on a pickup housing 60. The pickup housing 60 may be rotated to move the pickup roller 20 upward or downward to a standby position or a pickup position. For example, the pickup housing 60 may be rotatably connected to the rotation shaft 31*a* of the ADF roller 31. The ADF roller 31 and the pickup roller 20 may be connected by, for example, a belt (not shown). Thus, the pickup roller 20 and the ADF roller 31 may be rotated in the same direction. The pickup housing 60 may be elastically biased by an elastic member (not shown) to be rotated in a direction B1 in which the pickup roller 20 is positioned at the standby position. In this state, when the ADF roller 31 is rotated in a forward direction, i.e., a direction in which the document D is taken out of the tray 10, the pickup housing 60 is rotated about the rotation shaft 31*a* in a direction B2 and the pickup roller 20 is moved downward toward the document D in the tray 10. When the pickup roller 20 is brought into contact with an uppermost document D3 among a plurality of sheets of the document D loaded in the tray 10, the rotation of the pickup housing 60 stops. When the ADF roller 31 is continuously rotated, at least one sheet of the document D, including the document D3, is picked up by the pickup roller 20 and transferred to the separator 30.

A document feed speed (first speed) of the separator 30 is less than a document feed speed (second speed) of the pickup roller 20. This difference in feed speeds is because a document slip occurs at the separation nip 30*a* when each of the plurality of sheets of the document D is separated between the ADF roller 31 and the separation roller 32. A slip rate may be, for example, about 7 to 10% of a length of the document D. Because the first speed is less than the second speed, the document D may bend between the pickup roller 20 and the separator 30.

Figure 3:
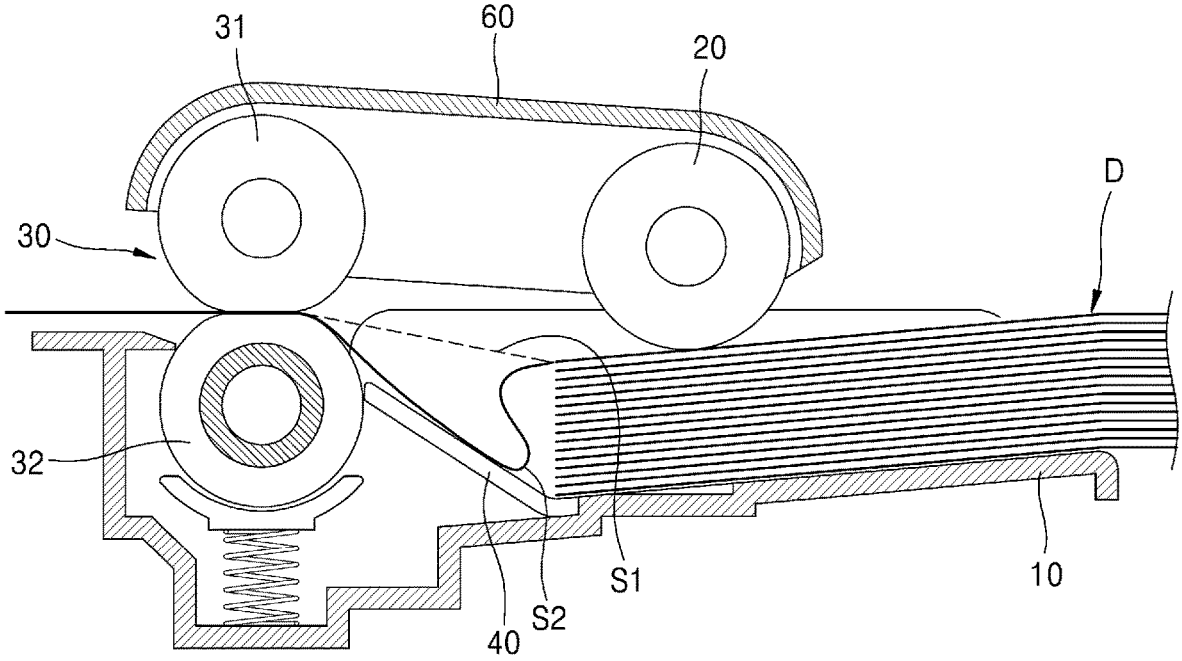
FIG. 3 is a view illustrating an example of a state in which a document is bent between a pickup roller and a separator when the number of sheets of a document loaded in a tray is large.

FIG. 3 is a view illustrating an example of a state in which a document D is bent between the pickup roller 20 and the separator 30 when the number of sheets of a document D loaded in the tray 10 is large. Referring to FIG. 3, when the number of sheets of the document D loaded in the tray 10 is large, the document D picked up by the pickup roller 20 is transferred to the separator 30 while not in contact with the inclined guide 40 between the pickup rollers 20 and the separator 30, as indicated by reference numeral S1. After a front end of the document D reaches the separation nip 30*a*, the document D is bent between the pickup roller 20 and the separator 30 toward the inclined guide 40 due to the difference between the first speed and the second speed. When the document D is bent, a bottom surface of the document D is brought into contact with the inclined guide 40 as indicated by reference numeral S2. When the number of sheets of the document D loaded in the tray 10 is large, an amount of warpage of the document D increases due to a large step between an uppermost sheet of the document D and the inclined guide 40. When the number of sheets of the document D loadable in the document feed device 1 employing the tray 10, which is a fixed tray, is about 100, a height of the document D loadable in the tray 10 is about 10 mm to about 12 mm and is thus not very high and accordingly, the amount of warpage of the document D is relatively small. When the number of sheets of the loaded document D is greater than 100, e.g., about 200, a height of the document D loaded in the tray 10 is about 20 mm to about 22 mm and a step between an uppermost sheet of the document D and the inclined guide 40 increases, thus resulting in an increase in the amount of warpage of the document D. In general, a thick document D with a large basis weight is easily returned to an original state due to high rigidity when bent and thus is not easily folded. A thin document D with a small basis weight is likely to be folded due to low rigidity when bent. In addition, even when moisture content of the document D is large, such as in a humid environment, the rigidity of the document D is low and thus the document D is likely to be folded when bent. Therefore, it is difficult to increase the document loading capacity of the document feed device 1 employing the tray 10, which is a fixed tray.

Figure 4:
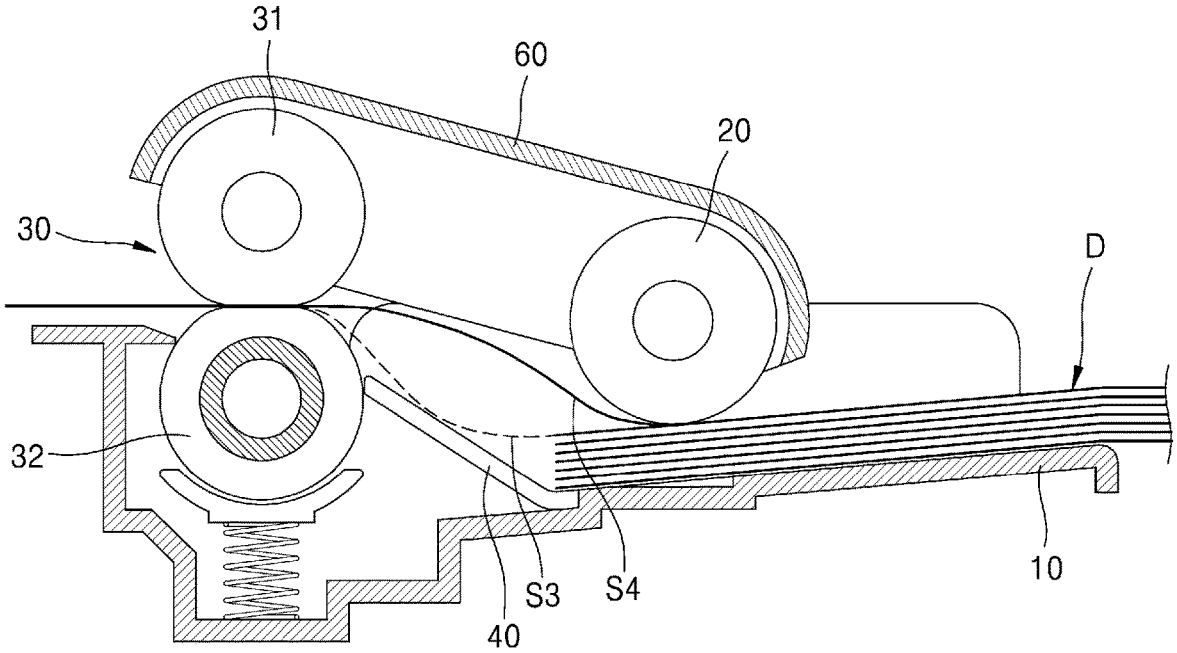
FIG. 4 is a view illustrating an example of a state in which a document is bent between the pickup roller and the separator when the number of sheets of the document loaded in the tray is small.

FIG. 4 is a view illustrating an example of a state in which a document D is bent between the pickup roller 20 and the separator 30 when the number of sheets of the document D loaded in the tray 10 is small. Referring to FIG. 4, when the number of sheets of the document D loaded in the tray 10 is small, the document D picked up by the pickup roller 20 is guided by the inclined guide 40 to be transferred to the separator 30 when brought into contact with the inclined guide 40 as indicated by reference numeral S3. After a front end of the document D reaches the separation nip 30*a*, the document D is bent between the pickup roller 20 and the separator 30 due to the difference between the first speed and the second speed but is prevented from being bent downward due to a small gap between the inclined guide 40 and the document D. The document D is bent upward as indicated by reference numeral S4. In this case, because an upper part of inclined guide 40 is spacious, the document D may be gently bent and thus the possibility that the document D may be folded is very low.

As described above, when the number of sheets of the document D loaded in the tray 10 is small, the document D when picked up may be supported by the inclined guide 40. When the number of sheets of the document D loaded in the tray 10 is large, a method of supporting the bottom surface of the document D, which is picked up and transferred to the separator 30, at a position protruding from the inclined guide 40 to reduce the amount of warpage of the document D between the pickup roller 20 and the separator 30 may be employed. To this end, as illustrated in FIG. 2, the document feed device 1 of the present example includes the document guide member 50. The document guide member 50 is moved to a first position (indicated by a solid line of FIG. 2) protruding from the inclined guide 40 to guide the picked-up document D or a second position (indicated by a broken line of FIG. 2) sunken below the inclined guide 40. The document guide member 50 may ascend or descend to the first position or the second position according to the number of sheets of the document D loaded in the tray 10. The document guide member 50 may be located at the first position when the number of sheets of the document D loaded in the tray 10 is large and located at the second position when the number of sheets of the document D loaded in the tray 10 is small. The document guide member 50 may be located at the first position when the number of sheets of the document D loaded in the tray 10 is a maximum number, and moved to the second position as the number of sheets of the document D loaded in the tray 10 decreases. The document guide member 50 may be located at the second position when the number of sheets of the document D loaded in the tray 10 is half the maximum number. For example, a maximum loading capacity of the tray 10 may be 200 sheets. The document guide member 50 may gradually descend from the first position to the second position as the number of sheets of the document D loaded in the tray 10 decreases from 200. When the number of sheets of the document D loaded in the tray 10 reaches 100, the document guide member 50 may be located at the second position sunken from the inclined guide 40. Due to the above configuration, the document loading capacity of the document feed device 1 employing the tray 10, which is a fixed tray, may be increased to 100 sheets or more, for example, 200 sheets. Therefore, the document feed device 1 having a large capacity may be implemented at low costs without employing a structure for moving the tray 10 upward or downward.

The pickup roller 20 descends from a standby position to a pickup position until the pickup roller 20 comes into contact with an uppermost document D3 among a plurality of sheets of document D loaded in the tray 10. Accordingly, a descending distance of the pickup roller 20 is in inverse proportion to the number of sheets of the document D loaded in the tray 10. That is, as the number of sheets of the document D loaded in the tray 10 decreases, the descending distance of the pickup roller 20 increases. According to the present example, a structure in which the document guide member 50 is moved to the first position or the second position in association with the upward or downward movement of the pickup roller 20 is employed. Due to the above configuration, a sensor for detecting the number of sheets of the document D loaded in the tray 10 and a driving mechanism for moving the document guide member 50 according to a detection signal from the sensor may be omitted. Accordingly, the document feed device 1 having a simple structure employing the document guide member 50, which is movable to the first or second position according to the number of sheets of a loaded document, and the tray 10, which is a fixed tray, may be implemented. In addition, the document feed device 1 having a large capacity and employing the tray 10, which is a fixed tray, may be implemented at low costs.

Because the document D is transferred between the pickup roller 20 and the tray 10, it is not easy to mechanically connect the pickup roller 20 to the document guide member 50. According to the present example, the pickup roller 20 is connected to the document guide member 50 in a non-contact manner. That is, the pickup roller 20 and the document guide member 50 are indirectly connected to each other. In the present example, the pickup roller 20 and the document guide member 50 are interlinked to each other by a magnetic force.

Referring to FIG. 2, the document guide member 50 may be supported on the tray 10 to be rotatably moved to the first position or the second position. An elastic member 52 applies an elastic force to the document guide member 50 in a direction toward the first position. For example, the document guide member 50 may include a rotation shaft 51 supported on the tray 10, a guide portion 501 extending from the rotation shaft 51, and an interference part 502 extending from the rotation shaft 51 in a direction opposite to the guide portion 501. The elastic member 52 may be implemented such that a winding portion is supported on the rotation shaft 51 of the document guide member 50, one arm is supported on the tray 10, and the other arm is supported on the document guide member 50. The document feed device 1 may include a stopper 15 that blocks the document guide member 50 from being moved beyond the first position. When the document guide member 50 is located at the first position, the interference part 502 is caught by the stopper 15 and thus the document guide member 50 may be maintained at the first position. As the pickup roller 20 is moved downward, the document guide member 50 is moved from the first position to the second position by a magnetic force. To this end, a first magnet 71 may be provided in the pickup housing 60. The document guide member 50 may be provided with a second magnet 72 having the same polarity as the first magnet 71. When the pickup roller 20 is moved downward to the pickup position, the first magnet 71 approaches the second magnet 72. The document guide member 50 is rotatably moved from the first position to the second position by a magnetic repulsive force between the first magnet 71 and the second magnet 72. When the pickup roller 20 is moved upward to the standby position, the first magnet 71 is moved away from the second magnet 72. As the magnetic repulsive force between the first magnet 71 and the second magnet 72 weakens, the document guide member 50 is rotatably moved from the second position toward the first position by the elastic force of the elastic member 52, the pickup roller 20 reaches the standby position, and the document guide member 50 may be returned to the first position.

Figure 5:
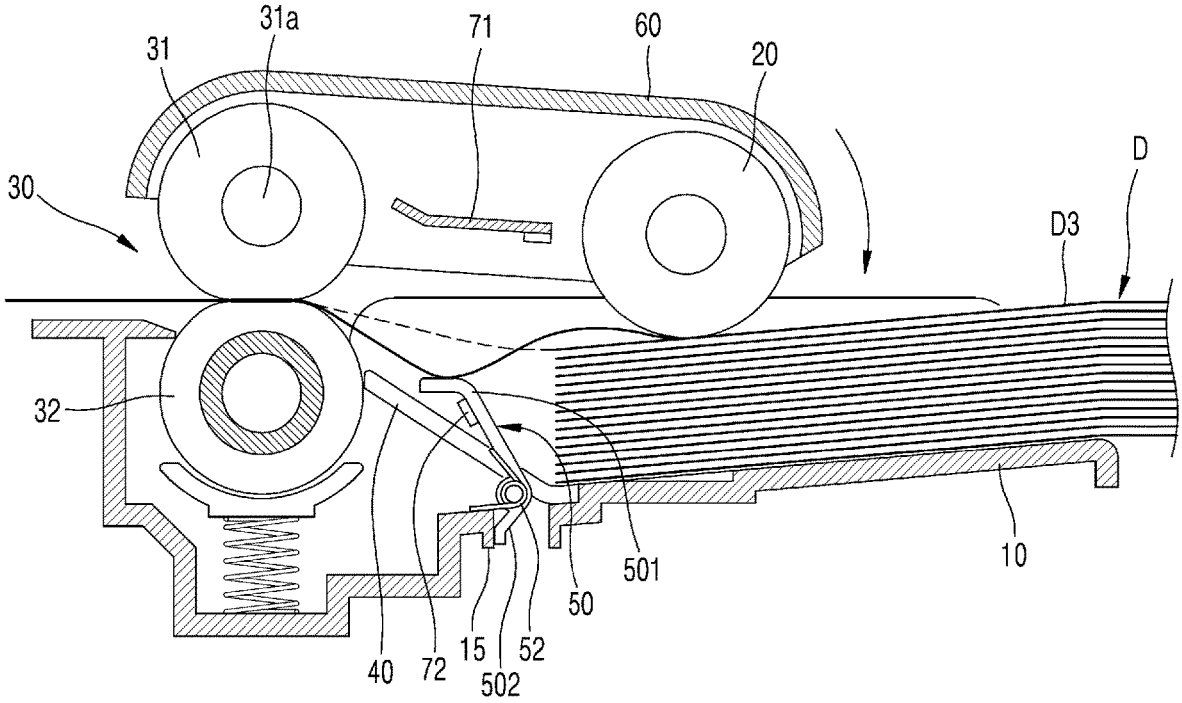
Figure 6:
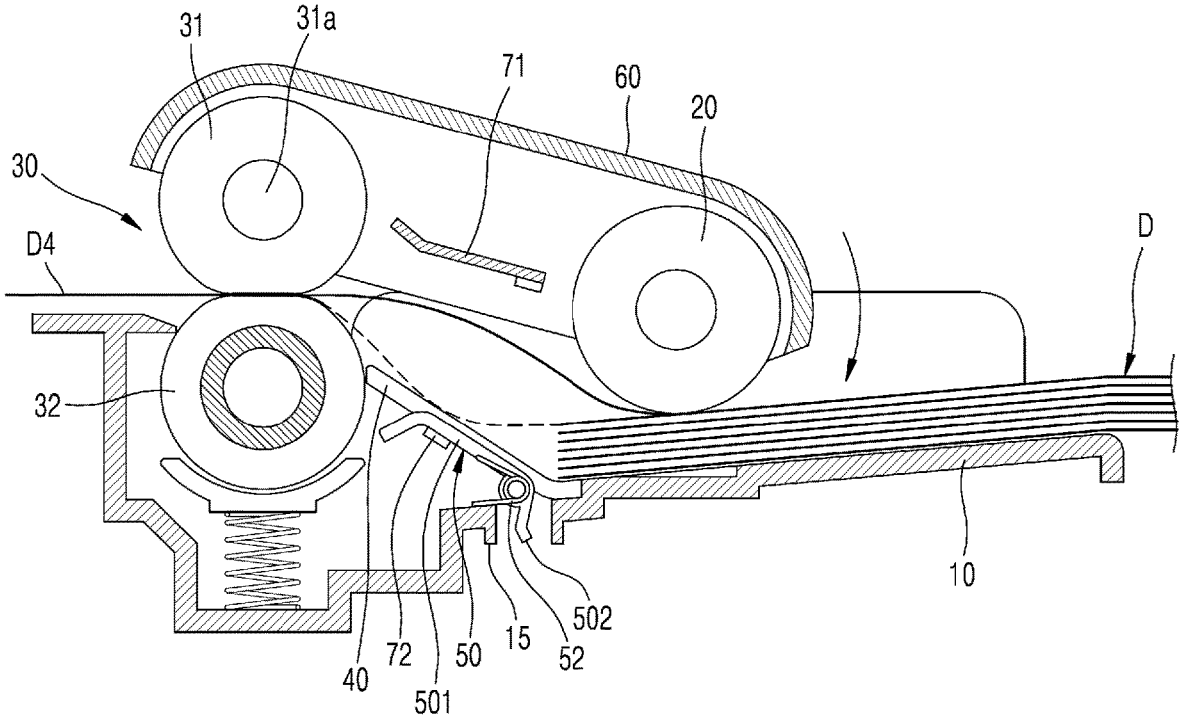

FIGS. 5 and 6 are views illustrating an example of an operation of the document guide member 50. FIG. 5 illustrates an example of a state in which the document guide member 50 is located at the first position when the number of sheets of a document D loaded in the tray 10 is large. FIG. 6 illustrates an example of a state in which the document guide member 50 is located at the second position when the number of sheets of the document D loaded in the tray 10 is small.

First, referring to FIG. 5, the maximum number of documents D, for example, 200 sheets of documents D, is stacked in the tray 10. The document guide member 50 is located at the first position by an elastic force of the elastic member 52. The guide portion 501 of the document guide member 50 protrudes to a greatest degree from the inclined guide 40. In order to pick up the document D, when the ADF roller 31 is rotated, the pickup housing 60 rotates about the rotation shaft 31*a* to move the pickup roller 20 downward from the standby position toward the tray 10. When the pickup roller 20 comes into contact with an uppermost document D3, the pickup roller 20 reaches the pickup position and the pickup housing 60 does no longer rotate. In this state, a magnetic repulsion force between the first magnet 71 and the second magnet 72 may be less than or substantially the same as an elastic force of the elastic member 52. Thus, the document guide member 50 may be maintained at the first position. However, the document guide member 50 may be slightly rotated from the first position toward the second position.

Next, when the ADF roller 31 is rotated, the document D3 is picked up and transferred toward the separator 30 as indicated by a broken line. After the document D3 reaches the separator 30, the document D3 is bent between the pickup roller 20 and the separator 30 due to the difference between the first speed and the second speed, as indicated by a solid line. Although the distance between the document D3 as indicated by a broken line and the inclined guide 40 is large, the guide portion 501 of the document guide member 50 at the first position protrudes from the inclined guide 40 and supports a lower surface of the document D3, and thus, the amount of warpage of the document D3 is not large. Therefore, the possibility that the document D3 may be folded, wrinkled, or jammed may be very low. The separator 30 transfers the document D3. When the document D3 is completely picked up, the rotation of the ADF roller 31 is stopped, and the pickup housing 60 is returned to the standby position by an elastic force of an elastic member (not shown).

As the sheets of the document D loaded in the tray 10 are sequentially picked up, the number of sheets of the document D remaining in the tray 10 is gradually reduced. A descending distance of the pickup roller 20 gradually increases. Thus, the first magnet 71 gradually approaches the second magnet 72. The document guide member 50 is rotated from the first position to the second position by a magnetic repulsion force applied between the first magnet 71 and the second magnet 72. The amount of rotation of the document guide member 50 from the first position to the second position increases as the number of sheets of the document D remaining in the tray 10 decreases. The document guide member 50 is rotated to a position at which the magnetic repulsion force applied between the first magnet 71 and the second magnet 72 and the elastic force of the elastic member 52 are balanced. When the document D is completely picked up, the rotation of the ADF roller 31 is stopped, and the pickup housing 60 is returned to the standby position by the elastic force of the elastic member. The first magnet 71 is separated from the second magnet 72, and the document guide member 50 is returned to the first position by the elastic force of the elastic member 52.

As illustrated in FIG. 6, the ADF roller 31 is rotated to pick up the document D in a state in which the number of sheets of the document D remaining in the tray 10 is half a maximum number of sheets, i.e., about 100. The pickup housing 60 rotates about the rotation shaft 31*a* and thus the pickup roller 20 descends from the standby position toward the tray 10. As the first magnet 71 approaches the second magnet 72, the document guide member 50 is rotated from the first position toward the second position by a magnetic repulsive force. When the pickup roller 20 comes into contact with an uppermost document D4, the pickup roller 20 reaches the pickup position and the pickup housing 60 no longer rotates. The document guide member 50 reaches the second position. The guide portion 501 of the document guide member 50 is located under the inclined guide 40.

Next, when the ADF roller 31 is rotated, the document D4 is picked up and brought into contact with the inclined guide 40 as indicated by a broken line and thus is guided toward the separator 30. After the document D4 reaches the separator 30, although the document D4 is bent between the pickup roller 20 and the separator 30 due to the difference between the first speed and the second speed, a lower surface of the document D4 is supported by the inclined guide 40 and thus the amount of warpage of the document D4 is not large, because the distance between the uppermost document D4 and the inclined guide 40 is small as indicated by a broken line. The document D4 may be bent in a direction away from the inclined guide 40 as indicated by a solid line. Therefore, the possibility that the document D4 may be folded, wrinkled, or jammed may be very low. The separator 30 transfers the document D4. When the document D4 is completely picked up, the rotation of the ADF roller 31 is stopped and the pickup housing 60 is returned to the standby position by the elastic force of an elastic member (not shown). The first magnet 71 is separated from the second magnet 72, and the document guide member 50 is returned to the first position by the elastic force of the elastic member 52.

As described above, in the document feed device 1 employing the document guide member 50 movable to the first position protruding from the inclined guide 40 or the second position sunken below the inclined guide 40 according to the number of sheets of the loaded document D, the document D may be prevented from being bent, folded, wrinkled, or jammed even when the number of sheets of the document D loaded in the tray 10, which is a fixed tray, is greater than 100. Therefore, the document feed device 1 having a large capacity and employing the tray 10, which is a fixed tray, may be implemented. Because the document guide member 50 is moved from the first position to the second position by a magnetic repulsion force, the document feed device 1 having a simple structure may be implemented. In addition, because there is no mechanical connection structure for connecting the pickup roller 20 to the document guide member 50, a paper jam occurring between the pickup roller 20 and the separator 30 may be easily handled.

Figure 7:
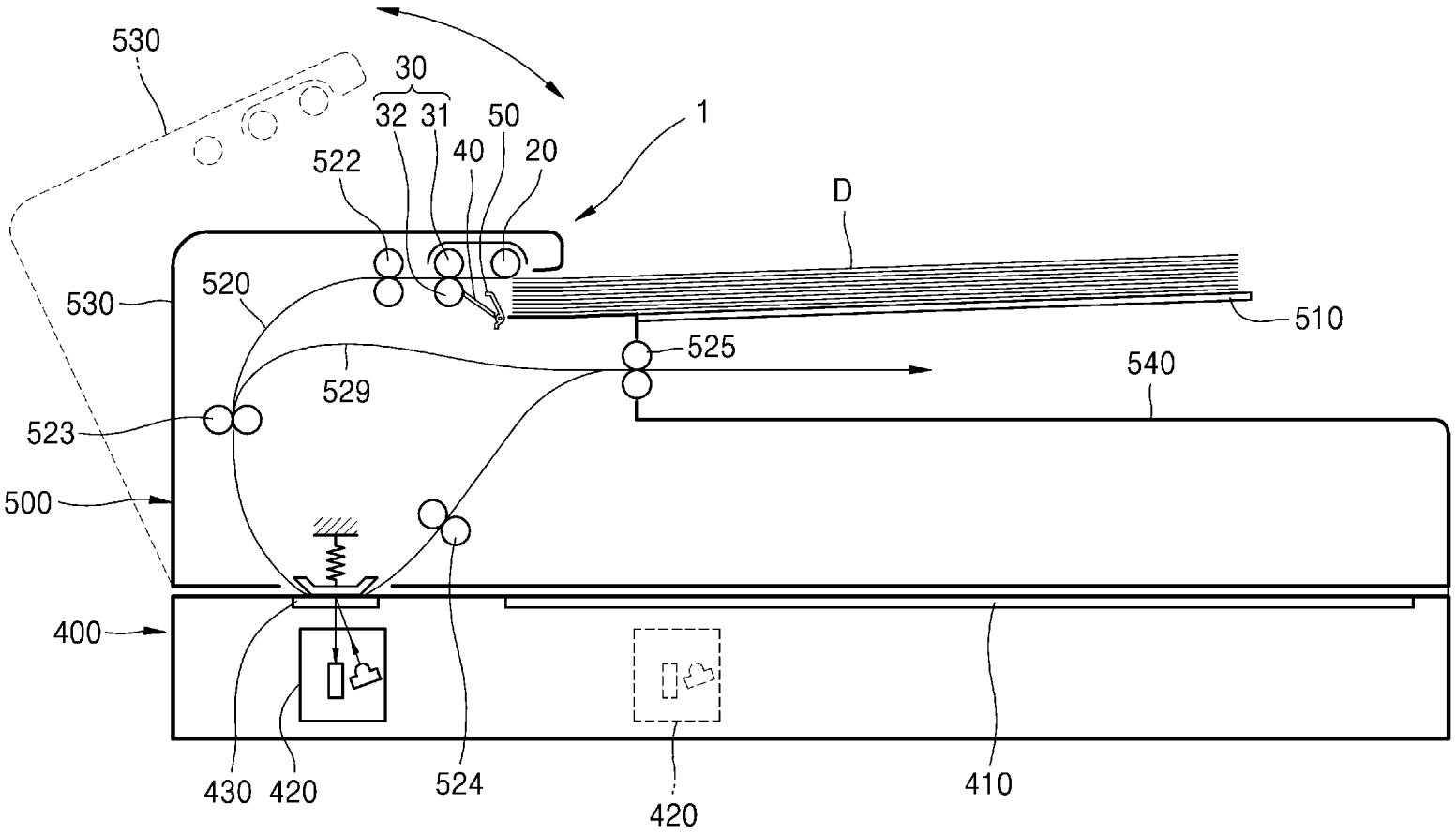
FIG. 7 is a schematic configuration diagram of an example of a scanner.

FIG. 7 is a schematic configuration diagram of an example of a scanner. Referring to FIG. 7, the scanner is a composite scanner, which is capable of performing a flatbed scan by placing a document D at a fixed position and moving a reading member 420 in a sub-scanning direction to read an image and is capable of performing a document feed scan by reading an image from the document D transferred in the sub-scanning direction by using the reading member 420 located at the fixed position. The scanner may include a lower unit 400 including platen glass 410 on which a document D is placed in a face-down state for a flatbed scan, and an upper unit 500 for transferring the document D in a document feed path 520 to perform the document feed scan.

The platen glass 410 is provided on an upper surface of the lower unit 400, i.e., a surface of the lower unit 400 opposite to the upper unit 500. The upper unit 500 may be switched between an open position to expose an upper portion of the platen glass 410 so as to place the document D on the platen glass 410 and a closed position to cover the platen glass 410. For example, the upper unit 500 is connected to the lower unit 400 to be rotatable to the open position or the closed position. The lower unit 400 is provided with the reading member 420.

The reading member 420 includes a light source for emitting light to the document D. and a photoelectric conversion element for converting an optical signal into an electric signal by receiving light reflected from the document D and performing photoelectric conversion on the light. A contact type image sensor (CIS), a charge-coupled device (CCD), or the like may be employed as the reading member 420. The reading member 420 is a one-dimensional (1D) sensor having a length in a main scanning direction. In order to obtain two-dimensional (2D) image data, in the case of a document feed scan, the document D is moved in the document feed path 520 in the sub-scanning direction, and the reading member 420 is located at a first reading position facing a reading window 430 to read an image from the document D. In the case of a flatbed scan, 2D image data may be obtained by placing the document D on the platen glass 410 and moving the reading member 420 in the sub-scanning direction to read an image from the document D.

The upper unit 500 is provided with a document feed device 1 that supplies each sheet of the document D to the document feed path 520. The document feed device 1 is as described above with reference to FIGS. 1 to 6. A plurality of document feed rollers 522, 523, 524, and 525 are arranged in the document feed path 520 to transfer the document D. For example, the document feed rollers 522 and 523 transfer the document D, which is supplied from the document feed device 1, in the document feed path 520. The document feed rollers 524 and 525 discharge the scanned document D to a discharge tray 540. Each of the document feed rollers 522, 523, 524, and 525 may include a pair of rollers that are rotated while being engaged with each other to transfer the document D between the pair of rollers. One of the pair of rollers may be a driving roller, and the other may be a driven roller that is pressed and rotated by the driving roller.

Although not shown, the scanner may include one or more sensors for detecting the document D transferred in the document feed path 520. For example, the at least one sensor may include a document detection sensor that detects whether a document D is placed in the tray 10, a reading start time detection sensor that detects a position of the document D at an upstream side of the reading member 420 to control timing of starting reading, and a discharge sensor that detects whether the document D is discharged after reading the document D. The at least one sensor may include an opening and closing sensor that detects whether the upper unit 500 is closed. The at least one sensor may include, for example, an actuator operated by the document D and a detector for detecting a position of the actuator. The detector may be implemented by, for example, an optical sensor such as a photo interrupter, a micro-switch, or the like.

The scanner may have a structure for double-sided scanning. For example, as illustrated in FIG. 7, the upper unit 500 may further include a reversing path 529 for guiding the document D, a first side of which has been scanned by the reading member 420, to the document feed path 520 by reversing the document D such that a second side faces the reading member 420. The reversing path 529 may extend from, for example, the discharge roller 525 and be connected to the document feed path 520 at an upstream side of the document feed roller 523. When single-sided scanning is selected, a controller (not shown) discharges the document D to the discharge tray 540 by driving the discharge roller 525 in a forward direction for a certain period of time after an end of the document D, the first side of which has been scanned by the reading member 420, is detected by the discharge sensor. When double-sided scanning is selected, when the end of the document D, the first side of which has been scanned by the reading member 420, is detected by the discharge sensor, the controller rotates the discharge roller 525 in a reverse direction to transfer the document D in the reversing path 529. In this process, the document D is reversed such that the second side faces the reading member 420. When a front end of the reversed document D is caught by the transfer roller 523, the discharge roller 525 is rotated in the forward direction. The reversed document D is transferred in the document feed path 520, and the reading member 420 reads an image from the second side of the document D. The document D, on which duplex scanning is completed, is discharged to the discharge tray 540.

A cover 530 may be opened or closed to partially open the document feed path 520. In this case, the ADF roller 31 and the pickup roller 20 may be rotated together with the cover 530 as indicated by a broken line of FIG. 7. Because the ADF roller 31 is separated from the separation roller 32, a document jam occurring during a pickup process may be easily handled. According to the present example, as the pickup roller 20 is moved upward or downward as described above, the document guide member 50 may be moved to the first position or the second position in the non-contact manner, e.g., a magnetic method. There is no mechanical connection member between the pickup roller 20 and the document guide member 50. Accordingly, a structure of opening the cover 530 may be simplified and document jams may be easily handled.

The document feed device 1 is applicable to a device for transporting a medium on a sheet. For example, a medium feed device includes a tray in which a sheet shaped medium is loaded, a pickup roller configured to be moved upward or downward to a standby position spaced apart from the medium or a pickup position for picking up the medium in the tray, a separator for separating each sheet of the picked-up medium, an inclined guide for connecting an end of an exit of the tray to an entrance of the separator and guiding a bottom surface of the picked-up medium, and a medium guide member movable to a first position protruding from the inclined guide to guide the picked-up medium or a second position sunken below the inclined guide. The medium feed device may be employed in a printer to supply each sheet of a print medium in a printing path. In this case, in the above description, a document may be replaced with the print medium, the document feed path may be replaced with the printing path, and an ADF roller may be replaced with an automatic sheet feed (ASF) roller.

It should be understood that examples described herein should be considered in a descriptive sense only and not for purposes of limitation. Descriptions of features or aspects within each example should typically be considered as available for other similar features or aspects in other examples. While one or more examples have been described with reference to the figures, it will be understood by those of ordinary skill in the art that various changes in form and details may be made therein without departing from the spirit and scope as defined by the following claims.

What is claimed is:

1. A document feed device comprising:

a tray in which a document including a number of sheets is loaded;

a pickup roller to be moved by a pickup housing upward or downward to a standby position spaced apart from the document or to a pickup position to pick up the document in the tray, the pickup housing comprising a first magnet;

a separator to separate each sheet of the picked-up document;

an inclined guide to connect an end of an exit of the tray to an entrance of the separator and to guide a bottom surface of the picked-up document; and a document guide member movable to a first position or a second position in association with an upward or downward movement of the pickup roller, the first position protruding from the inclined guide to guide the picked-up document or to a second position below the inclined guide, the document guide member comprising:

an elastic member to apply an elastic force to the document guide member in a direction toward the first position; and a second magnet having a polarity such that a repulsive magnetic force exists between the first magnet and the second magnet as the first magnet approaches the second magnet.

2. The document feed device of claim 1, wherein the document guide member is moved to the first position or the second position in association with an upward or downward movement of the pickup roller.

3. The document feed device of claim 2, further comprising a stopper to block the document guide member from being moved beyond the first position.

4. The document feed device of claim 1, wherein the document guide member is in the first position when a number of sheets of the document loaded in the tray is a maximum number, and is moved to the second position when the number of sheets of the document loaded in the tray decreases.

5. The document feed device of claim 4, wherein the document guide member is in the second position when the number of sheets of the document loaded in the tray is half the maximum number.

6. A document feed device comprising:

a fixed tray in which a document including a number of sheets is loaded;

a pickup housing to support a pickup roller to pick up the document, and to be rotatably movable to move the pickup roller to a standby position spaced apart from the document or to a pickup position in contact with the document in the fixed tray, the pickup housing comprising a first magnet;

a separator to separate each sheet of the picked-up document;

an inclined guide to connect an end of an exit of the fixed tray to an entrance of the separator and to guide a bottom surface of the picked-up document; and a document guide member rotatably movable to a first position or to a second position in connection with the rotatable movement of the pickup housing, wherein the first position protrudes from the inclined guide to guide the picked-up document and the second position is below the inclined guide, the document guide member comprising:

an elastic member to apply an elastic force to the document guide member in a direction toward the first position; and a second magnet having a polarity such that a repulsive magnetic force exists between the first magnet and the second magnet as the first magnet approaches the second magnet.

7. The document feed device of claim 6, wherein the document guide member is in the first position when the number of sheets of the document loaded in the fixed tray is a maximum number.

8. The document feed device of claim 7, wherein the document guide member is in the second position when the number of sheets of the document loaded in the fixed tray is half the maximum number.

9. An apparatus comprising:

a document feed device to feed each sheet of a document in a document feed path and comprising:

a tray in which a document including a number of sheets is loaded;

a pickup roller configured to be moved upward or downward to a standby position spaced apart from the document or a pickup position for picking up the document in the tray;

a pickup housing to support the pickup roller and to be rotatably moved to the standby position or the pickup position, the pickup housing comprising a first magnet;

a separator configured to separate each sheet of the picked-up document;

an inclined guide configured to connect an end of an exit of the tray to an entrance of the separator and to guide a bottom surface of the picked-up document; and a document guide member movable to a first position protruding from the inclined guide to guide the picked-up document or a second position below the inclined guide, the document guide member comprising a second magnet having a polarity such that a repulsive magnetic force exists between the first magnet and the second magnet as the first magnet approaches the second magnet;

an elastic member to apply an elastic force to the document guide member in a direction toward the first position; and a reading member to read an image from the document fed in the document feed path.

10. The apparatus of claim 9, wherein the document guide member is moved to the first position or to the second position in association with an upward or downward movement of the pickup roller.

11. The apparatus of claim 10, further comprising a stopper to block the document guide member from being moved beyond the first position.

12. The apparatus of claim 9, wherein the document guide member is at the first position when the number of sheets of the document loaded in the tray is a maximum number, and is moved to the second position when the number of sheets of the document loaded in the tray is half the maximum number.

* * * * *